United States Patent [19]

Koch et al.

[11] Patent Number: 4,931,064

[45] Date of Patent: Jun. 5, 1990

[54] METHOD AND APPARATUS FOR DISCONTINUOUS WET PROCESSING OF KNITTED OR WORKED TEXTILE MATERIAL

[75] Inventors: Werner Koch, Wald-Michelbach; Gunther Ruppert, Schwetzingen, both of Fed. Rep. of Germany

[73] Assignee: Bruckner-Apparatebau GmbH, Erbach, Fed. Rep. of Germany

[21] Appl. No.: 283,249

[22] Filed: Dec. 12, 1988

[51] Int. Cl.[5] ..... D06B 3/12

[52] U.S. Cl. ..... 8/149.1; 8/152; 68/13 R; 68/177; 26/71

[58] Field of Search ..... 68/13 R, 177; 26/71; 8/149.1, 149.2, 152

[56] References Cited

U.S. PATENT DOCUMENTS

| | | | |
|---|---|---|---|
| 3,686,905 | 8/1972 | Stanway | 68/177 X |
| 3,894,411 | 7/1975 | Stanway | 68/177 X |
| 4,006,612 | 2/1977 | Theis | 68/177 |
| 4,182,141 | 1/1980 | Sando et al. | 68/177 X |
| 4,318,209 | 3/1982 | Schuierer | 68/177 X |
| 4,747,190 | 5/1988 | Koch | 68/13 R |
| 4,799,367 | 1/1989 | Schuierer et al. | 68/13 R |

*Primary Examiner*—Frankie L. Stinson

*Attorney, Agent, or Firm*—Thomas & Kennedy

[57] ABSTRACT

The invention relates to a method and apparatus for the discontinuous wet processing of knitted or worked textile material (knitted fabric) (1) which circulates continuously in a tank (2), being passed through a resting zone (7) in the lower region of the tank and through a dipping vat containing a treatment liquor (14). In order in particular to be able to wet process even small production quantities economically, reliably and in open width, the textile material is spread by rollers (12 and 13) in the region of the dipping vat (before it and/or after it) and in the region above this dipping vat it has fluid removed from it by squeezer rolls (15) to a predetermined residual moisture content before it again enters the resting zone (7) in its continuous circulation.

18 Claims, 3 Drawing Sheets

METHOD AND APPARATUS FOR DISCONTINUOUS WET PROCESSING OF KNITTED OR WORKED TEXTILE MATERIAL

FIELD OF THE INVENTION

The invention relates to a method of discontinuous wet processing of knitted or worked textile material. The invention also relates to apparatus for carrying out this method.

BACKGROUND OF THE INVENTION

Knitted or worked textile material, that is to say so-called knitted fabric, is usually dyed or otherwise wet-processed in rope form in various suitable machines, such as for example winch tubs, jet, overflow or similar processing machines and apparatus. With all the differences in the said types of processing which derive from the particular system and apparatus used, processing in rope form predominates.

In particular, if such relatively sensitive knitted fabrics are to be subjected to dyeing in rope form, then a number of problems occur which lead above all to loss of quality. The main problems are the movement of the material, the distribution of the dye (product distribution) and the material quality.

The problems with the movement of the material in the processing apparatus result from material stoppages, looping points etc. The causes can lie in unsecured transport of the material at low processing temperatures, knotting of the rope of material in a storage and resting zone, and also in fundamental transport problems with extremely light or extremely heavy qualities of material and in the influence of foam, auxiliary agents used in dyeing and other chemicals.

An even and rapid distribution of the dye is crucial for a good degree of uniformity of the dyeing, but this can not be satisfactorily achieved when working with the material in rope form (for example with known methods and apparatus approximately two to five circulations of the textile material—corresponding to approximately five to fifteen minutes—are necessary in order to distribute the dyes necessary for the dyeing and other products approximately evenly on the same material).

All processing machines have a direct influence on the quality of the material to be obtained. For example, if one assumes an average processing time of approximately six hours and a circulation time of two minutes, then the textile material must pass approximately one hundred and eighty times through the transport arrangements, liquor supply arrangements, the material store etc. Because of the resulting rubbing against the material there is an undesirable roughening and slubbing of the material surface. Furthermore, a continuous crushing or squeezing of the material which is assembled into rope form occurs, which has a negative influence on the optical appearance of the surface thereof.

For textile material in the form of woven lengths, which are generally considerably more robust than knitted fabrics, it is also known for this textile material to be dyed, washed, rinsed etc. discontinuously in open width.

Because of the differences between knitted fabrics and woven materials based on their structure and technology, the methods and apparatus used for woven materials in the known constructions cannot be satisfactorily used. For example, it is not possible to dye knitted fabric of relatively unstable dimensions in a known conventional jigger.

SUMMARY OF THE INVENTION

The object of the invention, therefore, is to provide a method by means of which a uniform product distribution (distribution of the dye and other agents to be added) and a reliable guiding of the textile material (material transport) can be ensured by relatively simple constructional means and avoiding roughening of the surface of the textile material.

Since in this process according to the invention it is ensured that the textile material is specially spread in the region of the dipping vat, this textile material in the form of knitted fabric can always be passed in completely spread form through the dipping vat which is sufficiently filled with treatment liquor. This facilitates particularly intensive wet processing of this textile material, so that from the outset an extremely even distribution of the product (dyes and the like) to be applied to the textile material is ensured. In addition, the use of a dipping vat on the one hand and the transport of the textile material in open width on the other hand through the treatment liquor in the dipping vat lead to an extremely economical manner of treatment which can be operated using a relatively low bath ratio.

In this method according to the invention it is also particularly advantageous that the textile material has fluid removed mechanically to a predetermined residual moisture content in the region above the dipping vat before it is again introduced into the resting zone in the lower region of the tank via a reorientation and transport arrangement which is known per se. This method of removing fluid from the textile material after it has been transported a sufficient distance above the dipping vat also contributes to an accelerated and intensive distribution of the treatment products in all of the textile material. Thus, since a rapid and even distribution of the treatment products in the textile material (knitted fabric) is ensured, the entire wet processing operation requires fewer circuits in the processing tank that in the known constructions, so that an extremely gentle treatment of the surface of the material is ensured, thus ensuring that the desired character of the material is obtained.

According to a preferred embodiment it is particularly advantageous if the knitted or worked textile material in tubular form is spread out by inflation into a balloon and rendered free of pleats in the region between the dipping vat and the mechanical fluid removal.

According to another embodiment of the invention it is also advantageous if the multiple-knit and flat-knit textile material is mechanically spread out in the region before the dipping vat and aligned in its centre guiding. In this way collars and trimmings in particular can be wet processed, for example bleached, dyed and washed, extremely gently and effectively, that is to say this treatment is particularly suitable for knitted fabric which is produced flat and wide and is generally several times thicker than the normal circular-knit material (tubular material). Processing of this flat-knit material in rope form would lead to the material becoming deformed, limp and felted, whereas the wet processing according to the invention in open width results in the desired stability of this type of textile material and ensures an outstanding surface quality.

Apparatus for carrying out this method, includes a first guide roller for reorienting the strand of textile material rising out of the resting zone before the dipping vat and a second guide roller which dips the textile material into the treatment liquor is provided in the dipping vat.

One fundamental thought in the tests on which the invention is based was the desire to provide a method and particularly suitable apparatus for carrying it out in order above all for even small parts or quantities of knitted or worked textile material (knitted fabric) to be wet processed, especially dyed, bleached, washed and rinsed, with results which are equally good, at least qualitatively and economically, as is possible with known continuously operating methods and apparatus (on so-called continuous machines) with which, however, only relatively large quantities of textile material can be treated economically. In the tests the method according to the invention and the apparatus intended for carrying it out have proved extremely advantageous in the manner described above for the discontinuous wet processing, especially for dyeing with the processing stages before and after it.

BRIEF DESCRIPTION OF THE DRAWINGS

The invention will now be explained below on the basis of several examples and with the aid of the drawings.

In the drawings.

DETAILED DESCRIPTION

Figure 1:
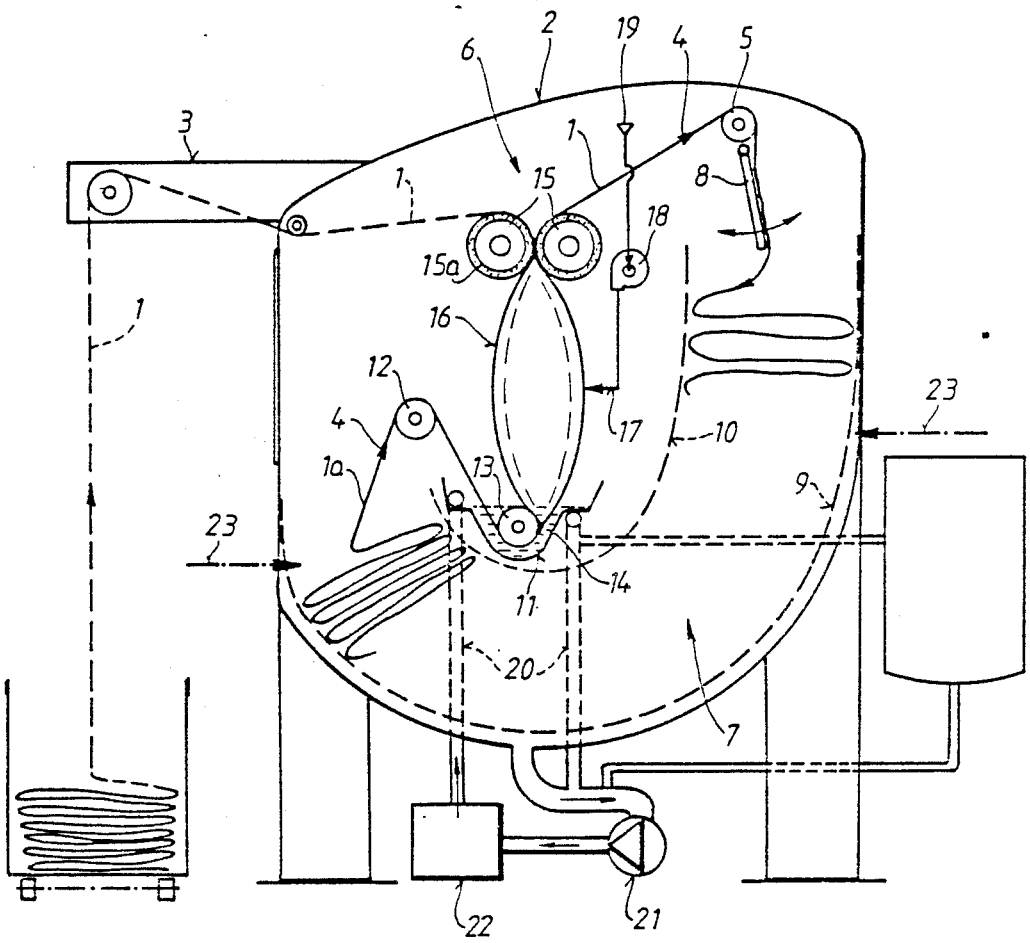
FIG. 1 shows a vertical sectional view through a discontinuously operating wet processing apparatus with appertaining equipment, for carrying out the method according to the invention.

The apparatus illustrated in FIG. 1 serves for the discontinuous wet processing of knitted or worked textile material which for the sake of simplicity will be referred to below as the knitted fabric 1.

This apparatus contains a tank 2 to which the knitted fabric 1 to be processed is delivered in the usual way via a gallows-like delivery arrangement 3. When a sufficient quantity of this knitted fabric 1 has been introduced into the tank 2 the front and rear ends of this stitched material 1 are sewn together so that the textile material can circulate continuously in open width in the direction of the arrows 4 inside the tank 2, for which purpose at least one driven transport roller 5 which is known per se or a known transport reel is provided (according to FIG. 1) in the right-hand upper region of the tank 2.

The upper region of the interior of the tank forms a sort of reorientation zone 6 for the continuously circulating knitted fabric 1, whilst the lower region of the interior of the tank forms a resting zone 7 for this knitted fabric 1. The knitted fabric 1 is layered in the resting zone 7 with the aid of a pleating device 8 which moves to and fro, is known per se and is arranged below the transport roller 5. The resting zone 7 is also preferably defined by a sliding grate 9 which is only indicated by broken lines and serves as a base as well as by a built-in part 10 which is also only indicated by broken lines and is provided approximately in the central region of the interior of the tank so that the resting zone 7 is a J-shaped zone which is open at its inlet and outlet ends.

A dipping vat 11 which extends at right angles (perpendicular to the drawing plane of FIG. 1) over the interior of the tank 2 is located approximately in the central portion of the interior of the tank, and in front of this dipping vat 11 a first guide roller (12) is arranged (guiding into the dipping vat 11) to reorientate the strand of knitted fabric 1*a* rising out of the resting zone 7, whilst a second guide roller 13 which dips the knitted fabric 1 into a treatment liquor bath 14 in the dipping vat 11 is provided inside the dipping vat 11. In addition these two guide rollers can at least partially ensure a spreading and central guiding of the knitted fabric 1 in the region of the dipping vat 11.

A mechanical fluid removal arrangement, which in the case of FIG. 1 is formed by two squeezer rollers 15 which are known per se, is provided spaced above the second guide roller 13 and the dipping vat 11. The squeezer rollers 15 have a soft rubber casing 15*a* (preferably with a hardness of 30° to 45° Shore hardness) on their outer periphery. The knitted fabric 1 which is guided between this pair of squeezer rollers 15 and thus partially surrounds these rollers passes as it is transported (arrows 4) through the tank 2 then over the transport roller 5.

The section which extends approximately vertically between the dipping vat 11 and the pair of squeezer rollers 15 is used to spread the knitted fabric 1 by inflating it to a balloon 16 and to render it free of creases. A nozzle system 17 is provided in this balloon inflation section, which is defined by the dipping vat 11 and the squeezer rollers 15, and with the aid of this nozzle system a suitable gaseous medium, especially compressed air, steam, nitrogen or another inert gas, can be blown into the knitted fabric 1 in a controllable manner if the material is present in tubular form.

As is indicated quite schematically, this nozzle 17 can be connected to a blower 18 which can be used approximately in the uppermost region of the interior of the tank with the aid of an intake piece 19 which is known per se to draw in gaseous medium (for example air or gas) which is present there for the inflation of the balloon 16.

A liquor circulation pipe 20 connected to the dipping vat 11 with a liquor circulating pump 21 and built-in heat exchanger 22 to prepare a treatment liquor which is controllable in both quantity and temperature are also associated in a known manner with the treatment tank 2. In addition, it is generally advantageous to provide the treatment tank 2 with a steam heating arrangement which is only indicated quite schematically in dot-dash lines by arrows 23 and can be used to heat the interior of the tank to the necessary treatment temperature. This can be both a direct heating of the interior of the tank or an indirect heating.

Figure 2:
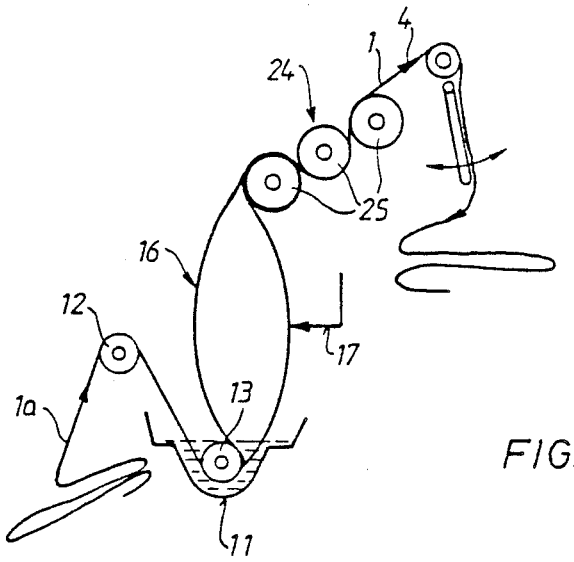
FIG. 2 is partial schematic view to explain another embodiment of the fluid removal arrangement (as a stretch-locking system)

As is only indicated roughly in the partial schematic view in FIG. 2, instead of the pair of squeezer rollers 15 according to FIG. 1 the fluid removal arrangement can also be constructed in the form of a so-called stretch-locking system 24 in which three guide rollers 25 are arranged close behind one another such small distances apart in the direction of transport (arrow 4) of the knitted fabric 1 that at least two sufficiently marked turns of the textile material are produced to achieve a sufficient degree of removal of fluid from the knitted fabric 1.

In this wet processing apparatus the question as to whether a pair of squeezer rollers 15 according to FIG. 1 or a stretch-locking system 24 according to FIG. 2 is used generally depends upon the desired fluid removal effect, i.e. a more controllable and stronger fluid removal effect (squeezing effect) can generally be achieved with the aid of the pair of squeezer rollers 15 than with the stretch-locking system 24.

Figure 3:
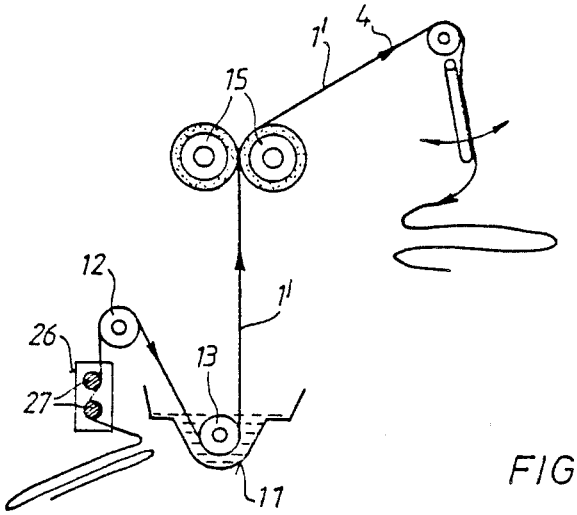
FIG. 3 is a partial schematic view similar to that of FIG. 2 but in order to explain an example in which a mechanical spreading arrangement is provided in the region before the dipping vat.

Whereas in the examples according to FIGS. 1 and 2 the processing apparatus is illustrated above all for the possibility of wet processing tubular knitted material 1, in which a balloon inflation section is provided and used between the second guide roller 13 of the dipping vat 11 and the fluid removal arrangement 15 or 24, this balloon inflation section can be omitted or shut down in the example according to FIG. 3 when multiple-knit or flat-knit material 1' is to be wet processed in this apparatus. In this case it is advantageous if a suitable spreading arrangement 26 which is preferably equipped with at least two spreading and centre guiding rollers 27 which are known per se for this type of textile material (knitted fabric 1') is arranged before the first guide roller 12 arranged before the dipping vat 11. Again, two squeezer rollers 15 (as indicated in FIG. 3) or a stretch-locking system 24 according to FIG. 2 can be provided by way of a fluid removal arrangement above the dipping vat 11.

When carrying out the method according to the invention with the aid of apparatus constructed in a suitable manner it is particularly economical and advantageous if the treatment liquor to be delivered to the knitted fabric 1 is only applied to the knitted fabric 1, 1' in the dipping vat 11, whilst the resting zone 7 in the tank 2 remains essentially free of liquor apart from liquor residues running or dripping down from the material, these liquor residues being immediately drawn off with the aid of the liquor circulating pump 21 at the base of the tank 2.

During the processing of the knitted fabric 1, 1' in this apparatus, after passing through the dipping vat the knitted fabric can have fluid deliberately removed from it with the aid of the pair of squeezer rollers 15 or the stretch-locking system 24 to a residual moisture content of approximately 100 to 250% based on the weight of the textile material. The excess treatment liquor squeezed out of the material can then run back along the section rising from the dipping vat 11 to the fluid removal arrangement. As has already been indicated above and can be seen in greater detail from the examples below, during its continuous circulation in the tank 2 the knitted fabric 1, 1' is preferably wet processed successively in at least two different treatment liquors which circulate separately one after the other through the dipping vat, for example washing, dyeing and rinsing liquors.

Depending upon the method used, the treatment liquors for the different types of treatment in one complete wet processing operation can be drained off and renewed individually, but often this is not necessary since for example the treatment liquor can renew itself between bleaching and washing. In this case it has been found that with this method according to the invention and in the apparatus intended for carrying out this method it is possible to operate with very small quantities of water, for example 20 to 30 l water/kg knitted fabric, for instance during rinsing.

Figure 4:
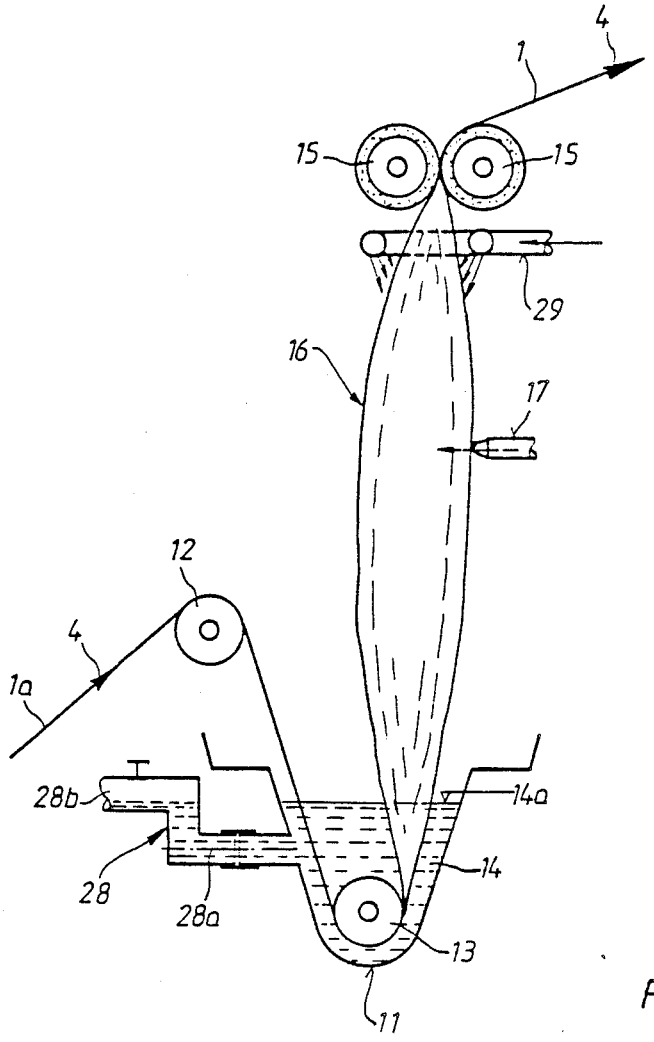
FIG. 4 shows a further partial schematic view in the region of the dipping vat and fluid removal arrangement in order to explain the counterflow/overflow rinsing.

During rinsing and in a similar manner also during bleaching and during a colour rewash it is possible to operate in the tank 2 with the dipping vat 11 in overflow, as is illustrated for instance in FIG. 4, which essentially shows an enlarged section of the apparatus according to FIG. 1—in the region from the dipping vat 11 to the pair of squeezer rollers 15.

The dipping vat 11 is provided with a siphon-like overflow pipe 28 through which the liquor level **14*a* in the liquor bath 14 of the dipping vat 11 can be set. This adjustment of the level of the liquor bath 14 can be carried out for example by rotating the overflow pipe 28 about its lower pipe axis 28*a*. The upper overflow end 28*b* of the overflow pipe 28 can then be connected for example to the circulation pipe 20** or also to a dirty liquor outlet.

It can also be advantageous to provide a fresh water or fresh liquor supply 29 just below the squeezer rollers 15 so that fresh water or fresh liquor can be sprayed (counterflow rinsing) on all sides from the outside onto the knitted fabric 1 (at the upper end of the balloon 16) which is being transported in the direction of the arrow 4.

If it is assumed in this construction (for instance FIG. 4) that with 100% liquor application to the knitted fabric 1 all of the dirt is dissolved at once, then at least 100% fresh water would have to be added in order to remove the dirt so that the concentration in the dipping vat 11 does not continually increase. In a test example for this type of counterflow and overflow rinsing according to FIG. 4 the following data were produced: With a knitted fabric of 500 g/meter run, with 100 kg fabric and a material speed of 40 m/min there was a circulation time of 5 min, that is to say there were twelve circulations per hour. Thus in one hour 1200 l dirty liquor were introduced, so that at least 1200 l fresh water/h should run in. In this rinsing of 100 kg knitted fabric good rinsing results could be obtained with 1200 l/h, which represents a bath ratio (knitted fabric: rinsing liquor) of 1:12. With twelve circulations per hour this constitutes a quite outstanding value. If this is compared with discontinuous apparatus and methods which are known per se and are generally used for processing material in rope form and in which bath ratios of 1:80 to 1:100 are normally to be expected, then outstanding and extremely economical bath ratios are produced in practice even when they are set approximately in the region of 1:20 to 1:30.

Moreover, in the different embodiments of the method according to the invention it can be particularly advantageous to operate in such a way that

- the atmosphere from the interior of the tank is used to form the balloon of tubular knitted fabric;
- in addition to the generally liquor-free operation in the resting zone during bleaching, dyeing and the like the lower region of the interior of the tank can also be flooded to a more or less great height in order to be able to set a greater bath ratio for example during preliminary cleaning of the knitted fabric;
- the interior of the tank can be heated directly or indirectly by steam to the desired liquor temperature;
- it is possible for all product additions (e.g. dyeing, bleaching and other chemicals) to be dosaged at a fixed time;

the tank of the apparatus can be constructed both for airtight and for atmospheric operation (important in vat dyeing);

the construction of the dipping vat 11 permits simple cleaning and easy drawing in of the material;

when the textile material which has already been processed is being taken out of the tank the squeezing arrangement there can be set in its squeezing vat so that a sufficient fluid removal effect can be achieved for subsequent direct drying.

The method according to the invention will be described below with the aid of some test examples in which various types of knitted fabric are discontinuously dyed.

EXAMPLE 1

In the wet processing apparatus described above 200 kg interlock knitted fabric made from cotton fibres were introduced in open width and sewn together in the tank to a continuous length of material. Then the treatment liquor and the knitted fabric were heated to 60° C. The knitted fabric was prewashed with approximately four circulations, and then 150 l of an aqueous liquor prepared in a preparation tank and also at 60° C. was added to the fluid bath, this added liquor containing 40 g/l common salt based on the total quantity of liquor in the dye bath. After the material had circulated for approximately 6 minutes 100 l of an aqueous reactive dye solution was added which contained—based on the weight of the material—2.5% of the dye reactive red and 2.5% of the dye reactive orange. Then the liquor temperature was increased in 10 minutes to 80° C., and wet processing continued for a further 10 minutes at this temperature.

100 l of a liquor at 80° C. which contained 15 g/l of calcined soda—based on the total quantity of liquor—were then added to fix the dye on the fibres. Then processing was carried out for 45 minutes at 80° C. The dyeing took place with a total bath ratio of 1:3.

In order to finish the dyeing, the dye liquor was drained off and the knitted fabric was rinsed without resting with fresh water and then soaped in the usual way.

The result was an even red dye in a total dyeing time of 4½ hours.

EXAMPLE 2

Just as in the first example, 200 kg of interlock knitted fabric were introduced into the tank of the apparatus, sewn together into a continuous length of material and then prewashed.

With the aid of a conventional dual-head dosaging pump (for different product additions) the following products were dosaged by level control with a mixture ratio of 1:4 (chemicals: dye liquor):

30 g/l reactive brilliant green
3 g/l wetting agent
0.2 g/l thickener as well as 50 g/l salt
13 g/l NaOH 36° Bé
1 g/l Calgon:

it was then levelled at 20° C. with two circulations. Then the treatment liquor and the knitted fabric were heated at approximately 2.5° C./min (and with more circulations of the knitted fabric) to 80° C., which brought the material to fixing.

In order to finish the dye the dye bath was drained off and fresh water was used for rinsing without the material stopping; then the material was soaped and softened as usual. When the knitted material was taken out of the tank it had fluid removed from it until it was ready for drying.

An even green dye was achieved in a total time of 3½ hours with a total water ratio of 1:40.

EXAMPLE 3

In a similar manner to that of the first example, 220 kg of a cotton knitted lining material were introduced and sewn together to an endless length.

The treatment liquor was heated to 80° C. and 150 l of a prepared aqueous liquor were added which—based on the total quantity of liquor in the dye bath—contained 2 g/l of a low-foaming wetting agent
1 g/l of the sodium salt of a condensation product of naphthalenic acid and formaldehyde
2 g/l of the sodium salt of a modified polyacrylic acid.

After the material had circulated twice vat dye dispersed in 100 l aqueous liquor at 45° C. were added in the combination of 3.0% green and 0.6% orange (based on the material weight).

After a pigmentation phase of 10 minutes 150 l of an aqueous liquor with 40 ml/l soda lye 38° Bé (32.5%) and 10 g/l sodium dithionite—based on the total quantity of liquor—were added by dosaging in 20 minutes. After that, processing was continued for a further 20 minutes at 80° C. and then rinsing was carried out with cold water in overflow until vat yellow paper only indicated a sodium dithionite concentration of 0.5 to 1 g/l (green colouring of the yellow paper).

After this short rinsing operation 200 l of a prepared liquor containing 2 g/l sodium salt of nitrobenzene sulphonic acid—based on the total quantity of liquor—were added by dosaging and the dye was oxidised at 60° C. during three or four circulations of the material. After oxidation the material was rinsed and then soaped in the usual way.

An even olive green colour of the raw fabric was obtained.

EXAMPLE 4

200 kg cotton knitted lining material were again introduced into the tank of the apparatus in open width, sewn together there to form a continuous length and prewashed (as in example 1).

By means of level control in the dipping vat the following products were added by dosaging:

15 g/l green
3 g/l orange
2 g/l wetting agent
5 g/l levelling agent
1 g/l sequencing agent
20 ml/l NaOH 36° Bé
10 g/l nitrosulphite.

The knitted fabric was levelled at 20° C. in two circulations. Then the interior of the tank was heated by means of direct steam heating to 100° C. and the material was brought to vatting in two to three circulations. Afterwards cold rinsing was carried out with one to two material circulations.

Then 4 g/l oxidising agent and 1 g/l $H_2O_2$ were dosaged into the aqueous treatment liquor at 60° C. and it was then acidified by means of pH regulation and the use of acetic acid. Then the material was hot rinsed and softened.

An even olive colour was obtained.

The tests which were carried out with the method according to the invention have made it clear that the manner of operation for discontinuous dyeing of knitted fabric in rope form which was generally used in the past particularly for smaller production quantities can be replaced by an extremely reliable manner of operation for knitted fabrics in open width with many advantages. The greatly improved material quantity should be mentioned above all. since by avoiding the undesirable crushing and squeezing of the material when processed in rope form an extremely even surface, a clear stitch image and thus a certain lustre can be achieved, which leads to a better quality material.

Since the method operates continuously with an even liquor charge, dyes and fixing chemicals are already very evenly distributed at the first material circulation. The levelling phase which was generally required in the different dyeing methods in the past can thus be considerably shortened or in many cases omitted completely. This results in considerably shorter processing times in the total dyeing process and a short rinsing time can be used because of the small liquor volume and liquor separation (particularly in the case of reactive dyes).

A further advantage can be seen in the low water consumption which has already been mentioned which is due above all to the operation in a bath ratio of approximately 1:2 to 1:5 and a better use of the rinsing water through the counterflow rinsing and a high bath separation. With light material shades which have to be pre-bleached total water consumptions of 1:40 to 1:60 can be reached, and with darker shades which do not have to be pre-bleached it is possible to work with similar water consumption since the bleaching liquor is omitted and can be used for subsequent washing.

We claim:

1. Method of discontinuous wet processing of knitted or worked textile material in which the textile material is circulated continuously in open width in a substantially closed tank, is led through a resting zone defined in the lower region of the tank, through a dipping vat positioned in the central portion of the tank in which treatment liquor is applied to the textile material, and through a reorientation zone defined in the upper region of the tank, characterized by spreading the textile material in the region of the dipping vat, and mechanically purging treatment liquor from the textile material in the region above the dipping vat to a predetermined residual moisture content and moving the textile material into the resting zone.

2. Method as claimed in claim 1 wherein the material is tubular in cross-sections and wherein the step of spreading the textile material is characterised by inflating the textile material to a balloon shape in the region above the dipping vat to render the textile material free of creases.

3. Method as claimed in claim 1 and wherein the step of spreading the textile material is characterised by mechanically spreading the textile material as the material is moved from the resting zone and toward the dipping vat.

4. Method as claimed in claim 1 and wherein the step of mechanically purging treatment liquor from the textile material is characterised by removing the fluid from the textile material after it has passed through the dipping vat to a residual moisture content of approximately 100% to 250% based on the weight of the textile material.

5. Method as claimed in claim 1 and wherein the step of mechanically purging fluid from the textile material is characterised by squeezing out the excess treatment liquor to achieve the mechanical removal of fluid from the textile material.

6. Method as claimed in claim 1 characterised by wet processing the textile material during its continuous circulation in the tank with at least two different treatment liquors, especially dyeing and rinsing liquors, circulating the different treatment liquors separately one after the other through the dipping vat, applying all of the necessary liquor to the textile material inside the dipping vat, and maintaining the resting zone substantially free of liquor.

7. Apparatus for discontinuously wet processing knitted or worked textile material which is being continuously raised from a resting zone and circulated through a dipping vat and treatment liquor is applied to the textile material as the textile material moves through the dipping vat, comprising a first guide roller positioned in the path of the textile material before the dipping vat for reorienting the strand of textile material rising out of the resting zone, and a second guide roller positioned within the dipping vat to dip the textile material into the treatment liquor of the dipping vat, and characterized in that a mechanical fluid removal arrangement (15, 24) including at least two fluid removal rollers (15, 25) is positioned in a spaced relationship above the second guide roller (13) and the dipping vat (11) so that the textile material passes between the fluid removal rollers and the rollers remove liquor from the textile material passing between the fluid removal rollers.

8. Apparatus as claimed in claim 7, characterised in that the second guide roller (13) of the dipping vat and the fluid removal rollers (15, 25) of the fluid removal arrangement define a balloon inflation area in which nozzles (17) are provided for the controllable inflation of the tubular textile material (1) with a gaseous medium.

9. Apparatus as claimed in claim 8, characterized in that a fresh water supply (29) is positioned at the upper end of the balloon inflation section for the counter-flow rinsing of the textile material, and the dipping vat (11) is equipped with a liquor overflow arrangement (28) for limiting the height of the liquor bath (4).

10. Apparatus as claimed in claim 7, characterised in that a mechanical spreading arrangement (26) with at least two spreading and centre guiding rollers (27) for the multiple-knit and flat-knit textile material (1') is arranged before the first guide roller (12) which is arranged before the dipping vat (11).

11. Apparatus as claimed in claim 7, characterised in that the fluid removal rollers of the fluid removal arrangement are provided in the form of a pair of squeezer rollers (15) and have a soft rubber casing (**15*a***) on their outer periphery.

12. Apparatus as claimed in claim 7, characterised in that the fluid removal rollers (25) of the fluid removal arrangement in the form of a stretch-locking system (24) are associated with at least two turns of the textile material.

13. Apparatus as claimed in claim 7, characterised in that the treatment tank (2) has associated with it a liquor circulation pipe (20) connected to the dipping vat (11) with a liquor circulating pump (21) and a built-in heat exchanger (22) to prepare a treatment liquor which is controllable in quantity and temperature and a steam heating arrangement (23) to heat the interior of the tank to the treatment temperature.

14. A method of discontinuous wet processing of tubular knitted or worked textile material and the like in which the textile material is continuously circulated along its length in a substantially closed tank, is moved from a resting zone in the lower region of the tank, is moved through a dipping vat and in the dipping vat treatment liquor is applied to the textile material, and is moved through a reorientation zone in the upper region of the tank and returned to the resting zone, the improvement comprising inflating the textile material in the region above the dipping vat as the textile material moves upwardly away from the dipping vat and removing fluid from the textile material mechanically in the region above the dipping vat and above the ballooned portion of the textile material to a predetermined residual moisture content in the textile material before the textile material is again introduced into the resting zone.

15. Method as claimed in claim 14 characterized by the step of inflating the textile material into a balloon-shape to remove creases in the textile material before mechanically removing fluid from the textile material.

16. Method as claimed in claim 14 characterized in that the textile material comprises multiple-knit or flat-knit textile material and further including the step of mechanically spreading the textile material before the step of applying treatment liquor to the textile material in the dipping vat.

17. Method as claimed in claim 14 characterized by the step of removing the fluid from the textile material until the textile material has a residual moisture content of approximately 100 to 250% based on the weight of the textile material as the textile material moves upwardly away from the dipping vat.

18. Method as claimed in claim 14 and further including the steps of wet processing the textile material successively with at least two different treatment liquors including at least dyeing and rinsing liquors, circulating separately and one after the other the different treatment liquors through the dipping vat, and applying all of the necessary liquor to the textile material inside the dipping vat so that the resting zone remains susbtantially free of treatment liquor.

* * * * *